US006679738B2

(12) United States Patent
Nimura

(10) Patent No.: US 6,679,738 B2
(45) Date of Patent: Jan. 20, 2004

(54) FEMALE TERMINAL

(75) Inventor: Kazuhiko Nimura, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/015,806

(22) Filed: Dec. 17, 2001

(65) Prior Publication Data

US 2002/0077000 A1 Jun. 20, 2002

(30) Foreign Application Priority Data

Dec. 18, 2000 (JP) ..... 2000-383770
Sep. 11, 2001 (JP) ..... 2001-274662

(51) Int. Cl.[7] ..... H01R 11/12
(52) U.S. Cl. ..... 439/852; 439/752.5
(58) Field of Search ..... 439/852, 851, 439/853, 843, 839, 850, 752.5

(56) References Cited

U.S. PATENT DOCUMENTS 5,112,254 A * 5/1992 Endo ..... 439/852
5,624,273 A * 4/1997 Myer ..... 439/399
5,690,517 A * 11/1997 Betsui ..... 439/839
5,980,336 A * 11/1999 Hall et al. ..... 439/843
6,183,312 B1 * 2/2001 Yamamoto ..... 439/748
6,305,992 B1 * 10/2001 Bouda et al. ..... 439/839
6,447,345 B2 * 9/2002 Sato et al. ..... 439/852

FOREIGN PATENT DOCUMENTS

JP 2-117672 9/1990
JP 11345644 12/1999

OTHER PUBLICATIONS

English Language Abstract of JP 11–345644.

* cited by examiner

*Primary Examiner*—Tho D. Ta
*Assistant Examiner*—Larisa Tsukerman
(74) *Attorney, Agent, or Firm*—Greenblum & Bernstein, P.L.C.

(57) ABSTRACT

A female terminal is provided that includes an angular tubular portion having adjacently disposed first and second walls. A base portion is provided at the first wall. A resilient contact extends from the base portion in a lengthwise direction, and is folded inwardly to extend within the angular tubular portion for elastically contacting a mating male terminal. The base portion has an end portion that extends toward the second wall in a widthwise direction. The angular tubular portion has a receiving portion positioned to receive the end portion of the base portion, thereby increasing a width of the resilient contact, and thus increasing a contact pressure of the resilient contact with respect to the mating male terminal.

16 Claims, 21 Drawing Sheets

FEMALE TERMINAL

BACKGROUND OF THE INVENTION

1. Field of the Invention

The present invention relates to a female terminal, and in particular to a female terminal having a resilient contact for making contact with a tab of a mating male terminal. Further, the present invention relates to a female terminal having a stabilizer.

2. Description of Related Art

A female terminal of the general type has an angular tubular portion at a front end thereof for inserting a mating male terminal. The interior of the angular tubular portion has a resilient contact formed from a portion that extends forwardly from the front end of the angular tubular portion. The female terminal is formed by bending a metal plate blank.

In a pre-formed condition of the above female terminal, the resilient contact projects forwardly from the front of the angular tubular portion, and is folded inwardly of the angular tubular portion so that the resilient contact can be brought elastically into contact with a tab of the male terminal within the angular tubular portion. The disadvantage of such a configuration is that the lengthwise dimension of the blank increases, thus resulting in a waste of the metal plate, i.e., a poor yield.

An improved female terminal offered for the purpose of the reduction of the lengthwise dimension is known in the art, such as, for example, a female terminal disclosed in the Japanese Unexamined Patent Publication No. HEI 11-345644.

As shown in FIGS. 7–9, an angular tubular portion 2 is provided at a front end of a female terminal 1, and a contact base portion 3 is provided on a part of the ceiling surface of the angular tubular portion 2. A resilient contact 4 is formed from a portion that extends rearwardly from the contact base portion 3, and is folded inwardly so that the resilient contact 4 extends forwardly within the angular tubular portion 2.

As shown in FIG. 9, in a pre-formed condition, the contact base portion 3 extends in a widthwise direction (lower side in FIG. 9) from the angular tubular portion 2, and the resilient contact 4 extends rearwardly (right side in FIG. 9) from the contact base portion 3. With such a configuration, unlike the general type of the female terminal, the lengthwise dimension of the blank does not increase, thereby decreasing the metal plate waste and thus improving the product yield.

However, in such an event where a resilient contact is disposed laterally of an angular tubular portion in its pre-formed condition, the resilient contact may overlap with or obstruct rearwardly positioned portions such as barrel portions, depending on the configuration of a female terminal. In such a case, it is very difficult or even impossible to design and produce such a female terminal.

In addition, the Japanese Unexamined Utility Model Publication No. HEI 2-117672 discloses another type of a prior female terminal fitting. This prior female terminal has an angular tubular portion at a front end thereof and a stabilizer. The stabilizer is configured to project outwardly from the angular tubular portion to aid insertion of the female terminal into a connector housing in a proper orientation.

However, since the stabilizer projects outwardly, it is susceptible to deformation by interference with other members. Moreover, since the stabilizer is in the form of a single plate, merely extending flushly from a single-plate side wall of the angular tubular portion, it has a little strength, and is easily deformed or bent from its root portion by interference with other members.

The present invention has been developed after taking the above problems into consideration, and an object thereof is to provide a female terminal wherein a resilient contact provided thereon can maintain a sufficient contact pressure with respect to the mating male terminal. Another object of the present invention is to provide a female terminal which prevents the deformation or bending of a stabilizer.

SUMMARY OF THE INVENTION

As a solution to this problem, it was conceived to provide, for example, a female terminal 10 as shown in FIGS. 10–11. In the pre-formed condition of this female terminal 10, a contact base portion 14 extends laterally in a widthwise direction, and a resilient contact 15 extends rearwardly from the contact base portion 14, as in the case of the female terminal 1. However, the contact base portion 14 is folded under to lie beneath the lower surface of a ceiling wall 12 of an angular tubular portion 11, at a folded end portion 13 provided at a side edge of the ceiling wall 12. Accordingly, in its pre-formed condition, the resilient contact 15 extends lengthwise, spaced apart from the angular tubular portion 11 sufficiently in a widthwise direction to avoid overlapping with or obstructing rearwardly positioned portions.

However, in this female terminal 10, since the folded end portion 13 is provided interiorly of the inner surface of the angular tubular portion 11, the width W1 of the resilient contact 15 becomes small, as illustrated. As a result, contact pressure with respect to a mating male terminal is reduced.

To solve the above problems, and/ or other associated problems, the present invention provides a female terminal. The female terminal has an angular tubular portion that extends in a lengthwise direction. The angular tubular portion has an insertion opening at one end thereof for inserting a mating male terminal, and adjacently disposed first and second walls that extend in the lengthwise direction.

The female terminal further has a base portion at the first wall of the angular tubular portion, and the base portion has an end that extends toward the second wall in a widthwise direction. A resilient contact extends from the base portion in the lengthwise direction, and is folded inwardly so that the resilient contact extends within the angular tubular portion for elastically making contact with a tab of the mating male terminal. The angular tubular portion has a receiving portion positioned to correspond to, and receive the end portion of the base portion.

In accordance with the above construction of the present invention, the width of the resilient contact can be increased. Therefore, a contact pressure of the resilient contact with respect to the tab of the mating male terminal can be increased without increasing the size of the angular tubular portion. Thus, this construction is particularly effective in the case where the female terminal is to be miniaturized.

According to a preferred embodiment of the present invention, the resilient contact has a width substantially the same as an inner width of the angular tubular portion. Hence, a contact pressure of the resilient contact with respect to the tab of the mating male terminal will be increased without increasing the size of the angular tubular portion.

In a further aspect of the invention, the receiving portion is formed in at least one of the first and second walls and positioned to correspond to and receive the end portion of the base portion. Preferably, the end portion of the base portion is fixedly secured within the receiving portion.

In a further aspect of the present invention, the end portion of the base portion extends through the receiving portion, and projects beyond an outer surface of the second wall to form a guide member or a stabilizer that aids insertion of the female terminal into a connecting device in a proper orientation.

In a further aspect of the invention, the receiving portion includes a cut-away portion formed between and first and second walls, and the cut-away portion has a window that allows the end portion of the base portion to be observed from an interior side of the first wall.

In another aspect of the invention, the base portion is formed from a double wall structure, and the end portion of the base portion is formed form a folded end portion. Preferably, the receiving portion includes a cut-away portion formed between the first and second walls, and an edge of the cut-away portion tightly engages the base portion at or in the vicinity of the folded end portion, thereby preventing the folded end portion from being deformed open.

In a further aspect of the present invention, the folded end portion extends through the receiving portion, and rigidly projects from an outer surface of the second wall to form a guide member or a stabilizer that aids insertion of the female terminal into a connecting device in a proper orientation.

Further, the present invention provides a female terminal. The female terminal has an angular tubular portion that extends in a lengthwise direction. The angular tubular portion has an insertion opening at one end thereof for inserting a mating male terminal, and has adjacently disposed first and second walls that extend in the lengthwise direction. The angular tubular portion further has a base portion at the first wall. The base portion is formed from a double wall structure folded doubly, and includes a folded end portion That extends toward the second wall in a widthwise direction. The angular tubular portion also has a resilient contact extending from the base portion in the lengthwise direction for elastically contacting a tab of the mating male terminal, and a receiving opening formed in at least one of the first and second walls and positioned to correspond to and receive the folded end portion of the base portion.

In a further aspect of the present invention, an edge of the receiving opening tightly engages the base portion in proximity of the folded end portion, thereby preventing the folded end portion form being deformed open.

Preferably, the receiving opening is formed between the first and second walls, and has a window that allows the folded end portion of the base portion to be observed from an exterior side of the first wall.

In a further aspect of the invention, the folded end portion extends through the receiving portion, and rigidly projects from an outer surface of the second wall to form a guide member that aids insertion of the female terminal into a connecting device in a proper orientation.

Furthermore, the present invention provides a female terminal. The female terminal has an angular tubular portion that extends along a longitudinal direction. The angular tubular portion has a bottom wall, opposed side walls protruding upwardly from side edges of the bottom wall, and a top wall having upper and lower wall portions. The upper and lower wall portions protrude inwardly from the opposed side walls so that the upper wall portion is positioned in an overlying relationship with respect to the lower wall portion, The angular tubular portion further has a cut-away portion formed in at least one of the top wall and the side walls, and a double wall stabilizer configured to aid insertion of the female terminal into a cavity of a connector housing in a proper orientation. The double wall stabilizer includes a double wall structure formed from the lower wall portion of the top wall. The double wall stabilizer extends out of an outer surface of the angular tubular portion through the cut-away portion, and is tightly secured at a root portion thereof in the cut-away portion.

In accordance with the above construction of the present invention, the double wall stabilizer is formed into a double thickness structure. Hence, it can maintain a greater strength than that of a single thickness structure. Moreover, since the root portion of the double wall stabilizer is secured within the cut-away portion, it is possible to prevent the stabilizer from deforming or bending in a direction perpendicular to the protruding direction of the double wall stabilizer.

In a further aspect of the invention, the cut-away portion is formed at an upper end portion of one side wall. The double wall stabilizer has a folded end portion of the lower wall portion of the top wall forming the double wall stabilizer that protrudes through the cut-away portion in a direction parallel to a plane of the upper wall portion of the top wall and in a direction perpendicular to the longitudinal direction. With this construction, since the stabilizer protrudes laterally from the angular portion, a height of the female terminal can be reduced, compared to that with a stabilizer protruding upwardly form an angular tubular portion. Accordingly, a height of a connector housing, into which the female terminal is inserted, can be reduced.

In another aspect of the present invention, the cut-away portion is formed in the upper wall portion of the top wall. The double wall stabilizer has an upwardly protruding portion of the lower wall portion forming the double wall stabilizer that extends through the cut-away portion in a direction perpendicular to a plane of the upper wall portion of the top wall. The double wall stabilizer is tightly secured at the root portion within the cut-away portion. An end portion of the lower wall portion extends toward the side wall and is secured within a support opening formed in one of the side walls.

According to a preferred embodiment of the present invention, a resilient contact extends from the lower wall portion in the longitudinal direction for elastically making contact with a mating male terminal, and end portion of the lower wall portion is tightly secured within the support opening, so that the lower wall portion supports the double wall stabilizer. Preferably, the double wall stabilizer is formed by buckling upward left-side and right-side plate portions of the lower wall portion so that the double wall stabilizer projects upwardly at a central portion of the left-right direction of the lower wall portion of the top wall.

BRIEF DESCRIPTION OF THE DRAWINGS

Other features of the invention will be apparent from the following description of preferred embodiments shown by way of example only in the accompanying drawings in which.

DETAILED DESCRIPTION OF THE PREFERRED EMBODIMENTS

A first embodiment of the present invention will be described below with reference to FIGS. 1–6.

A female terminal 20 of the present embodiment is manufactured in the following manner.

Figure 6:
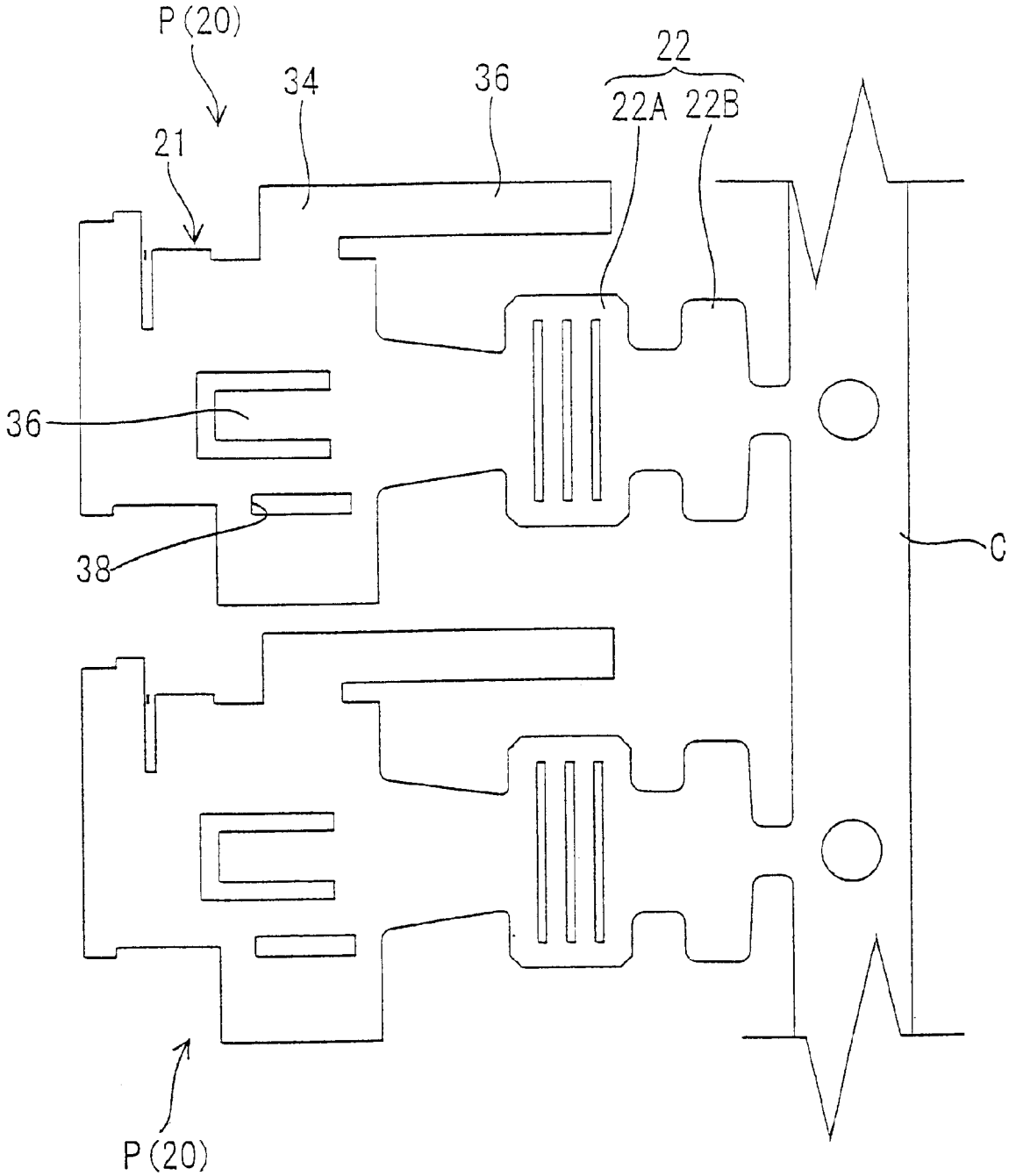
FIG. 6 is a plan view illustrating a blank of the female terminal according to the first embodiment of the present invention.
Figure 7:
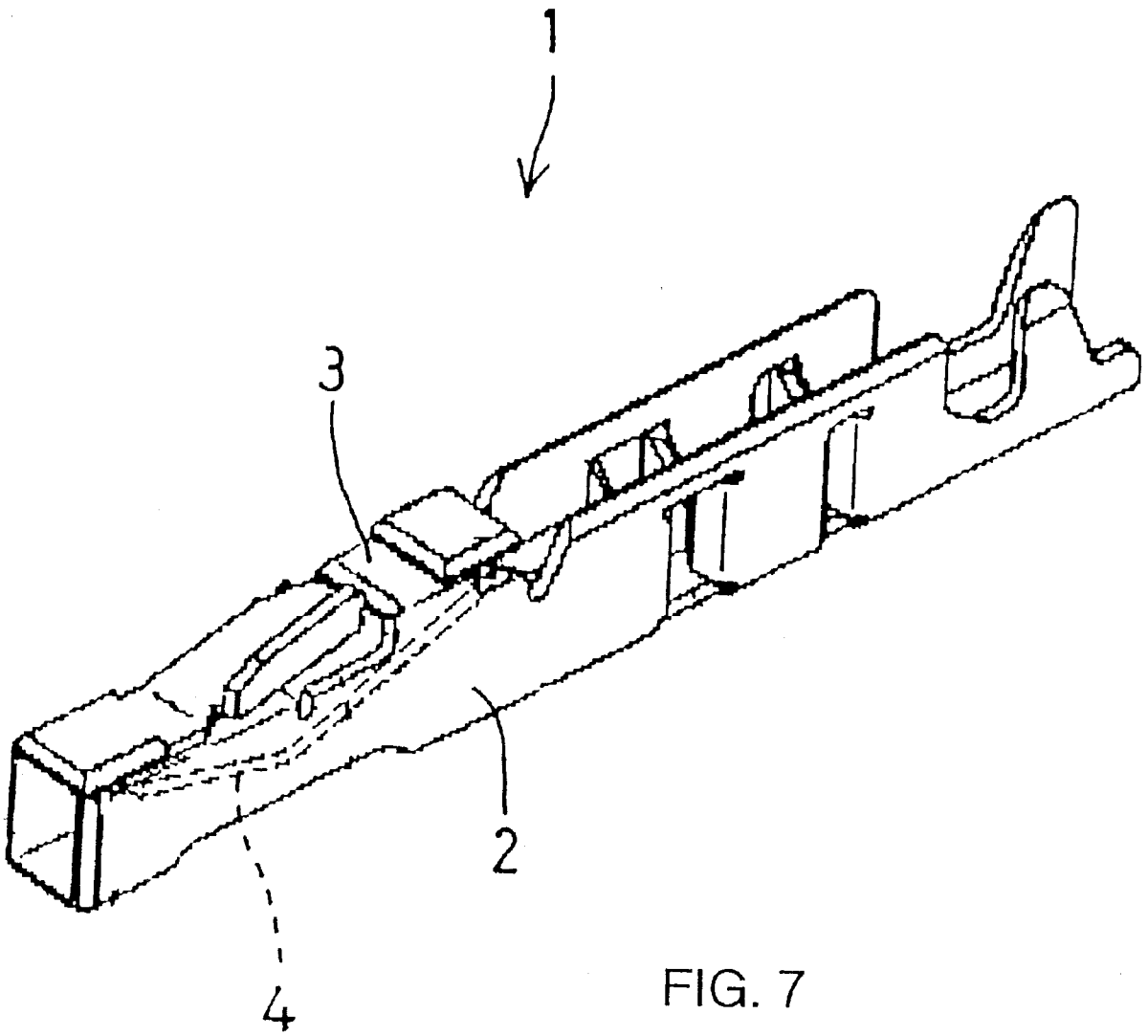
FIG. 7 (PRIOR ART)
FIG. 7 is a perspective view illustrating a conventional female terminal.
Figure 8:
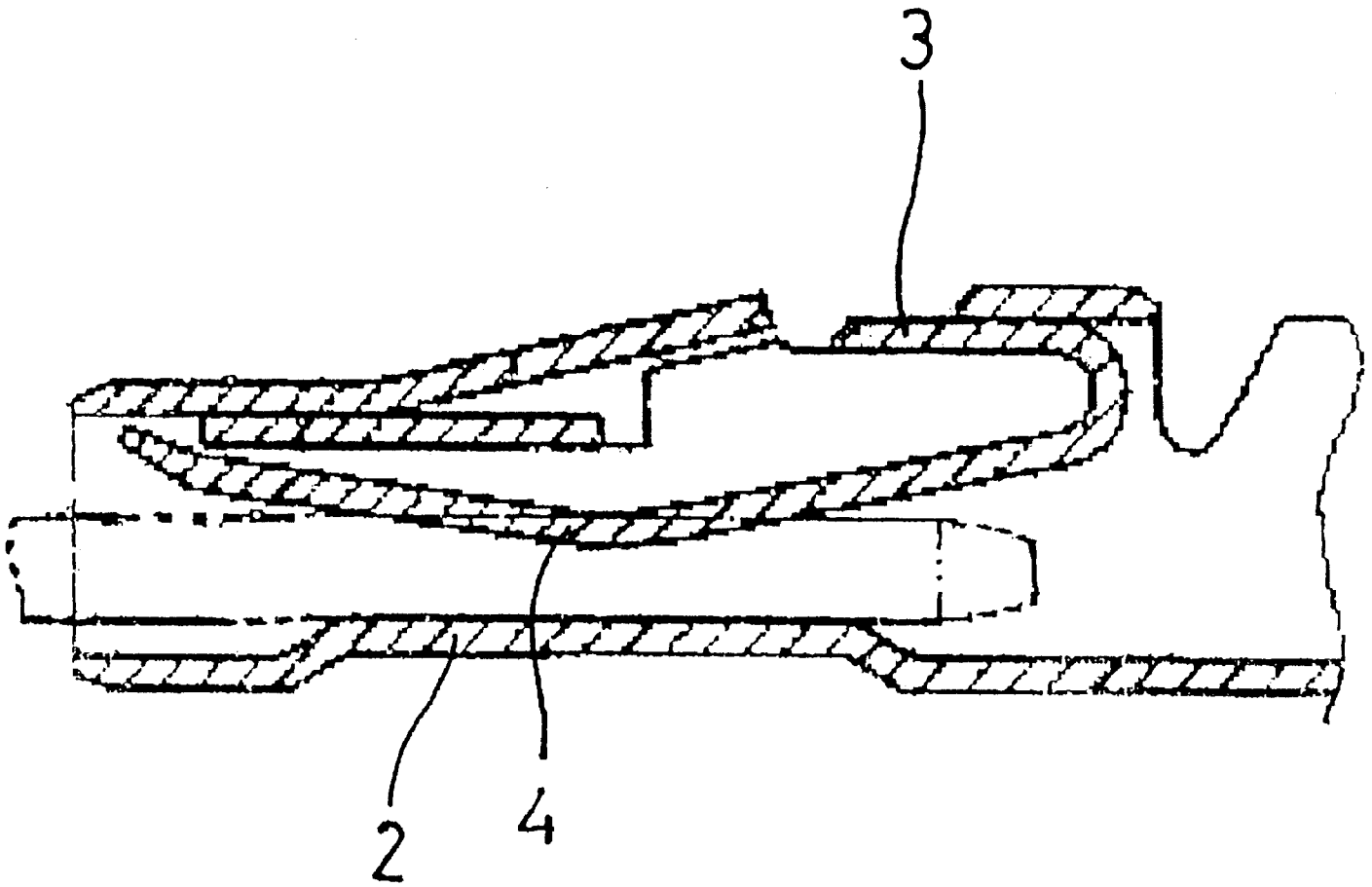
FIG. 8 (PRIOR ART)
FIG. 8 is a side cross-sectional view of the conventional female terminal.
Figure 9:
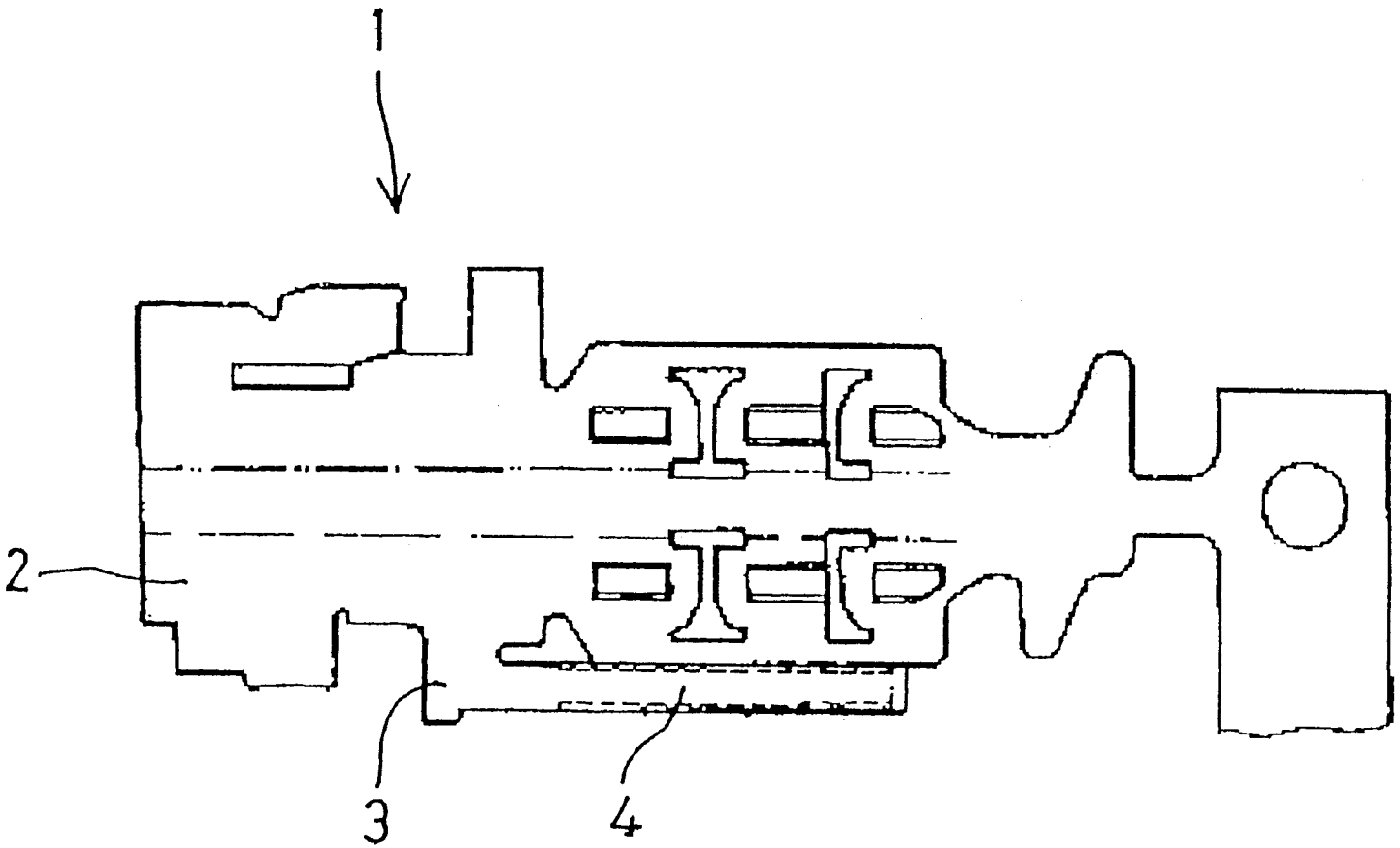
FIG. 9 (PRIOR ART)
FIG. 9 is a plan view showing a blank of the conventional female terminal.
Figure 10:
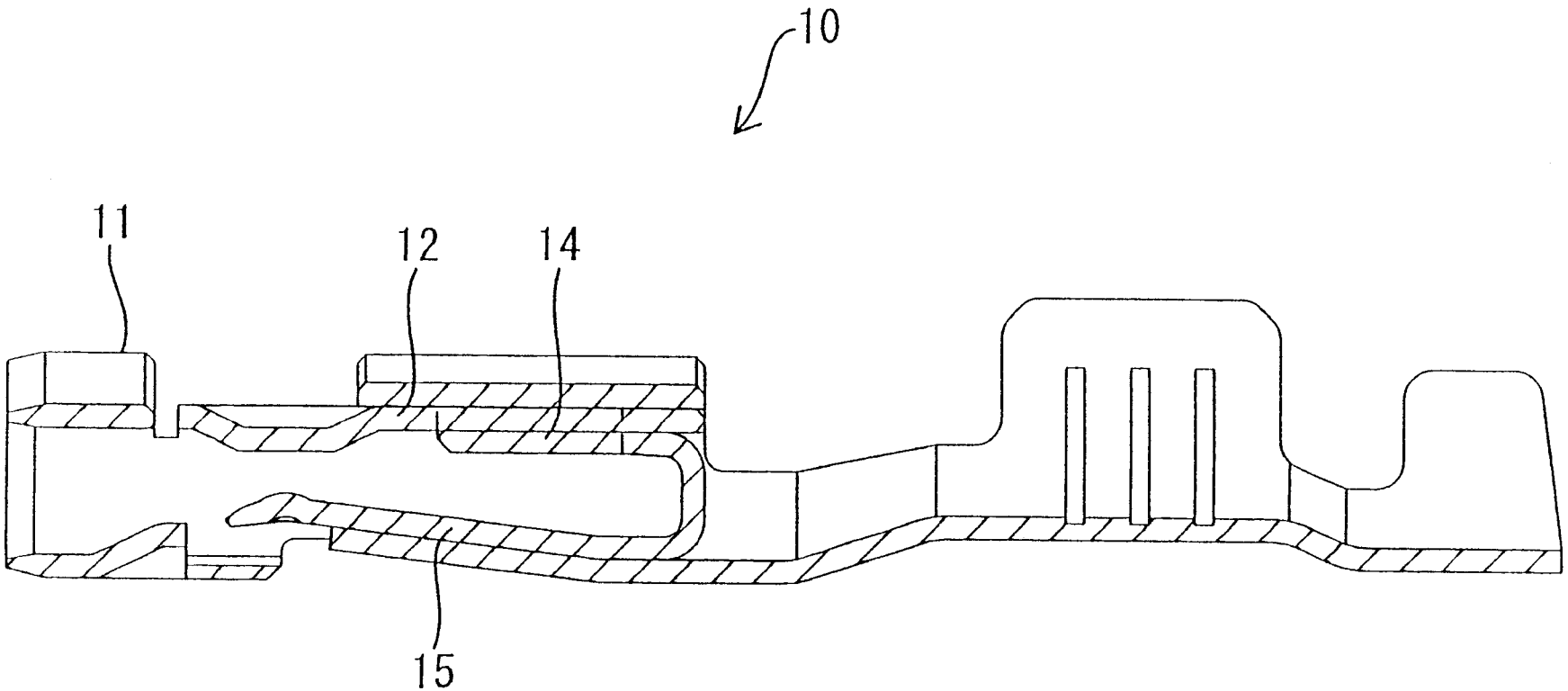
FIG. 10 is a side cross-sectional view showing a female terminal wherein a folded end portion is provided interiorly of the inner surface of an angular tubular portion.
Figure 11:
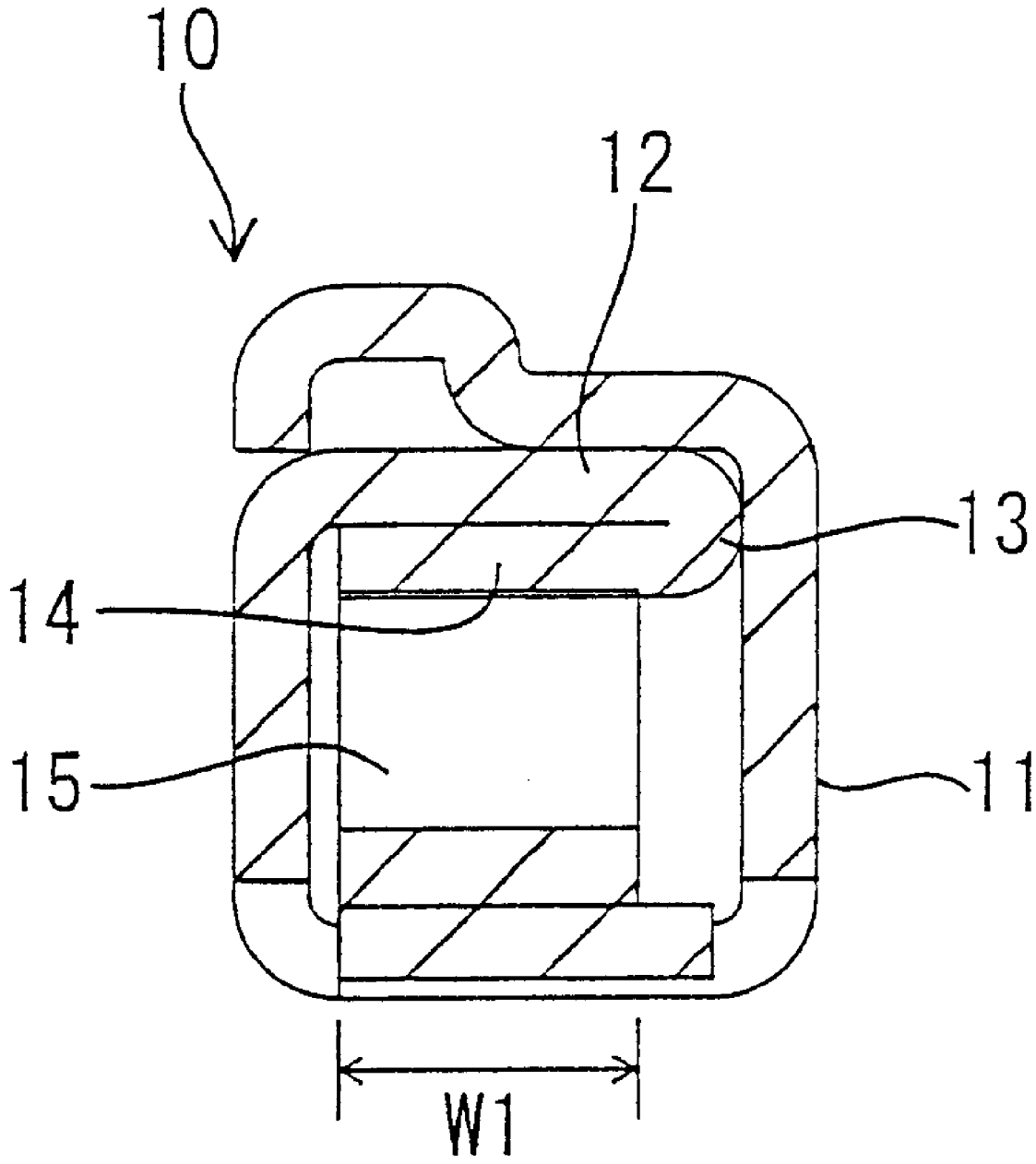
FIG. 11 is a front cross-sectional view showing a female terminal wherein a folded end portion is provided interiorly of the inner surface of the angular tubular portion.

First, an electrically conductive metal plate is punched into a predetermined configuration, as shown in FIG. 6. Therein, a plurality of blanks P are unitarily connected in juxtaposition in a widthwise direction (upward and downward direction in FIG. 6) at the rear ends thereof (right side in FIG. 6), through a belt-shaped carrier strip C. Subsequently, the blanks P are bent as necessary to form the respective female terminals 20, and then separated from the carrier strip C.

Figure 1:
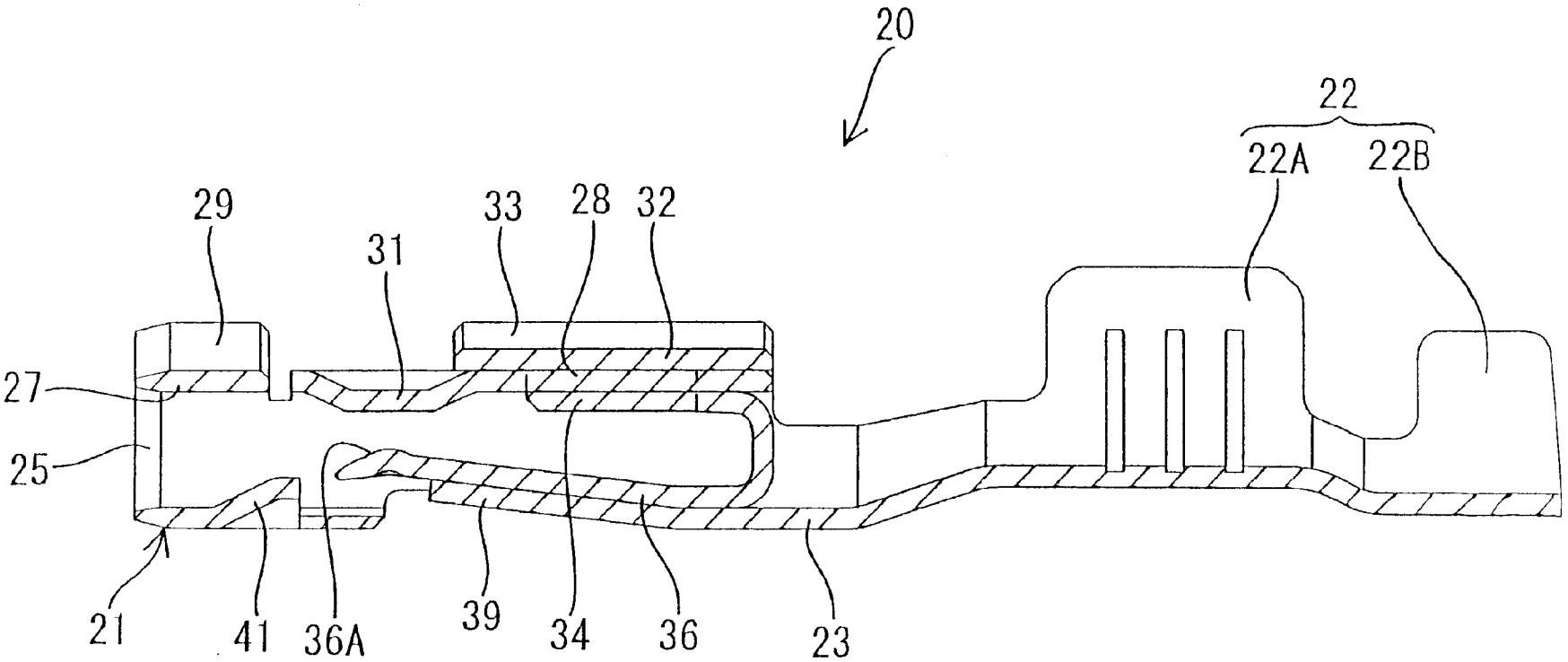
FIG. 1 is a side cross-sectional view illustrating a female terminal of a first embodiment of the present invention.
Figure 2:
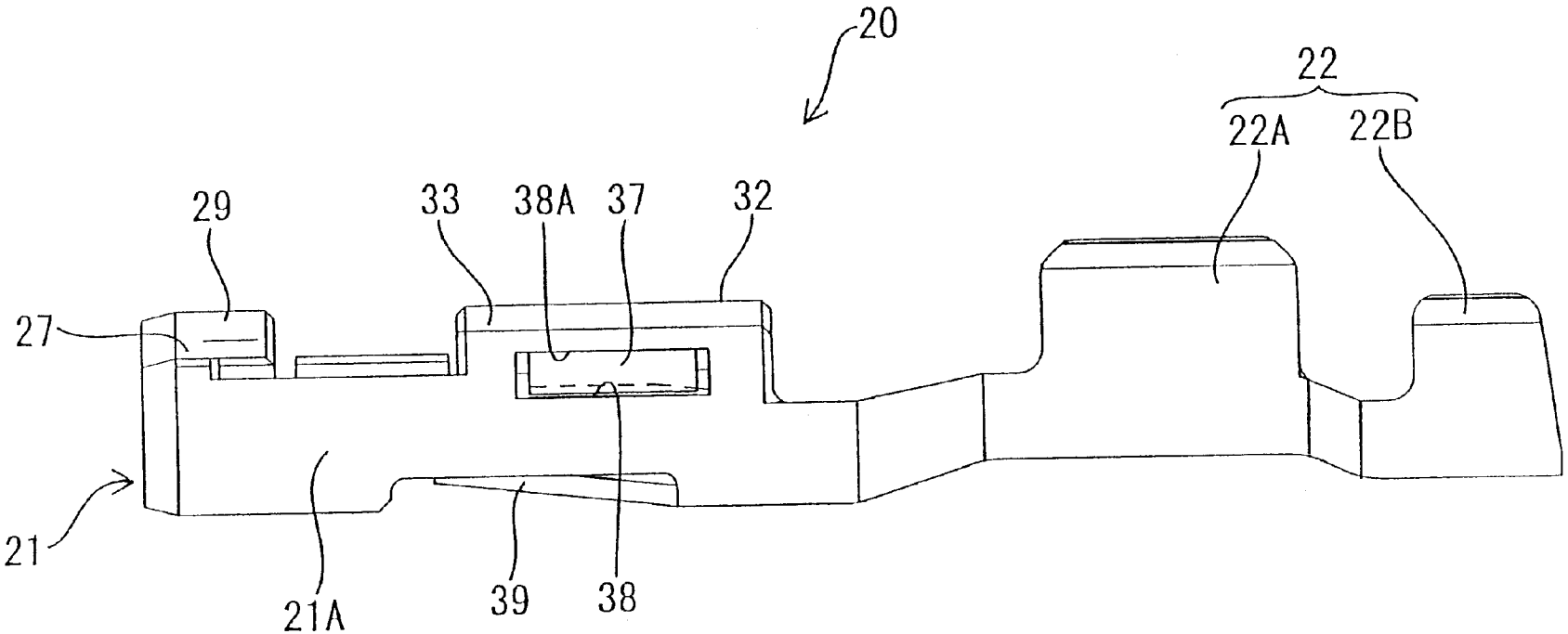
FIG. 2 is a side view of the female terminal according to the first embodiment of the present invention.
Figure 3:
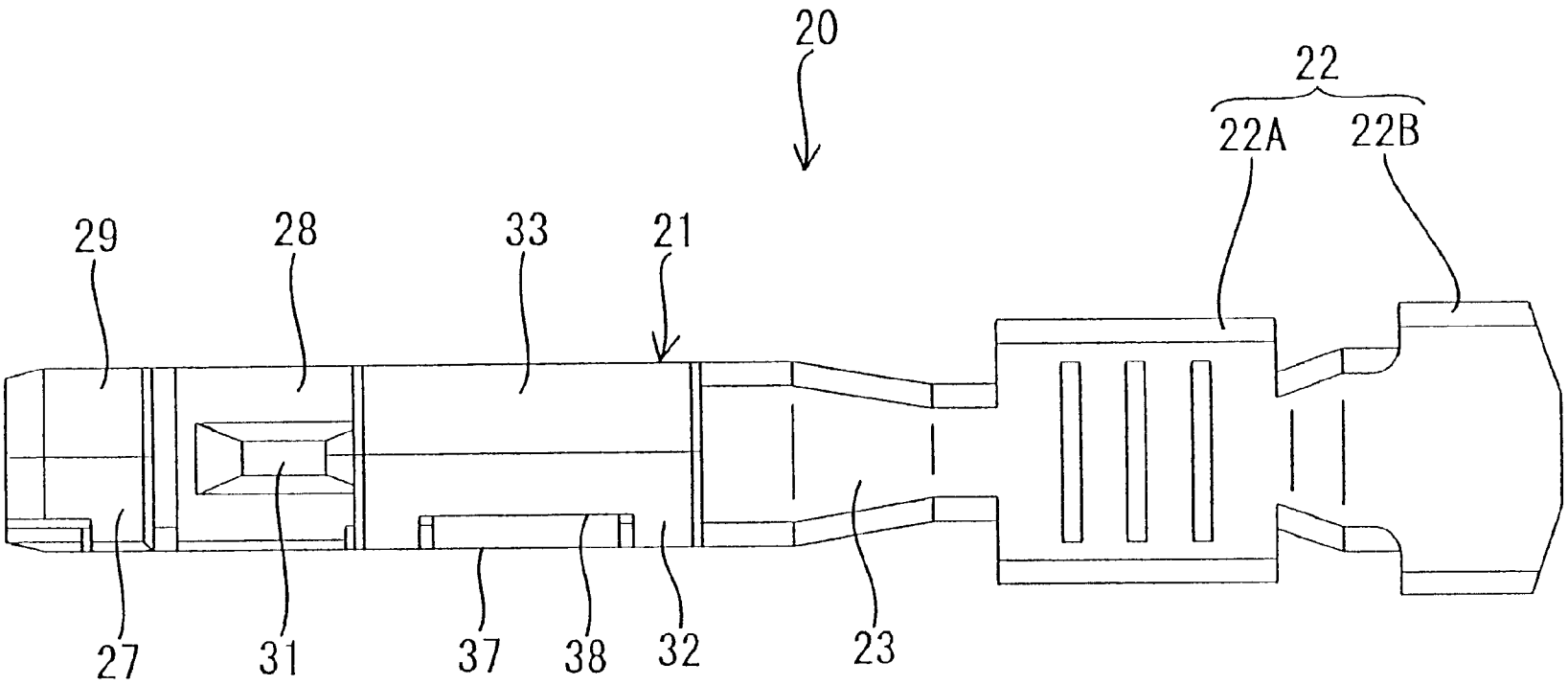
FIG. 3 is a plan view of the female terminal according to the first embodiment of the present invention.

As best seen in FIG. 1, the female terminal 20 forms a long and narrow shape in a forward-rearward direction, and has an angular tubular portion 21 at the front thereof for inserting a tab of a mating male terminal (not shown) and a barrel portion 22 at the rear thereof for connecting an end of an electric wire (not shown).

Figure 4:
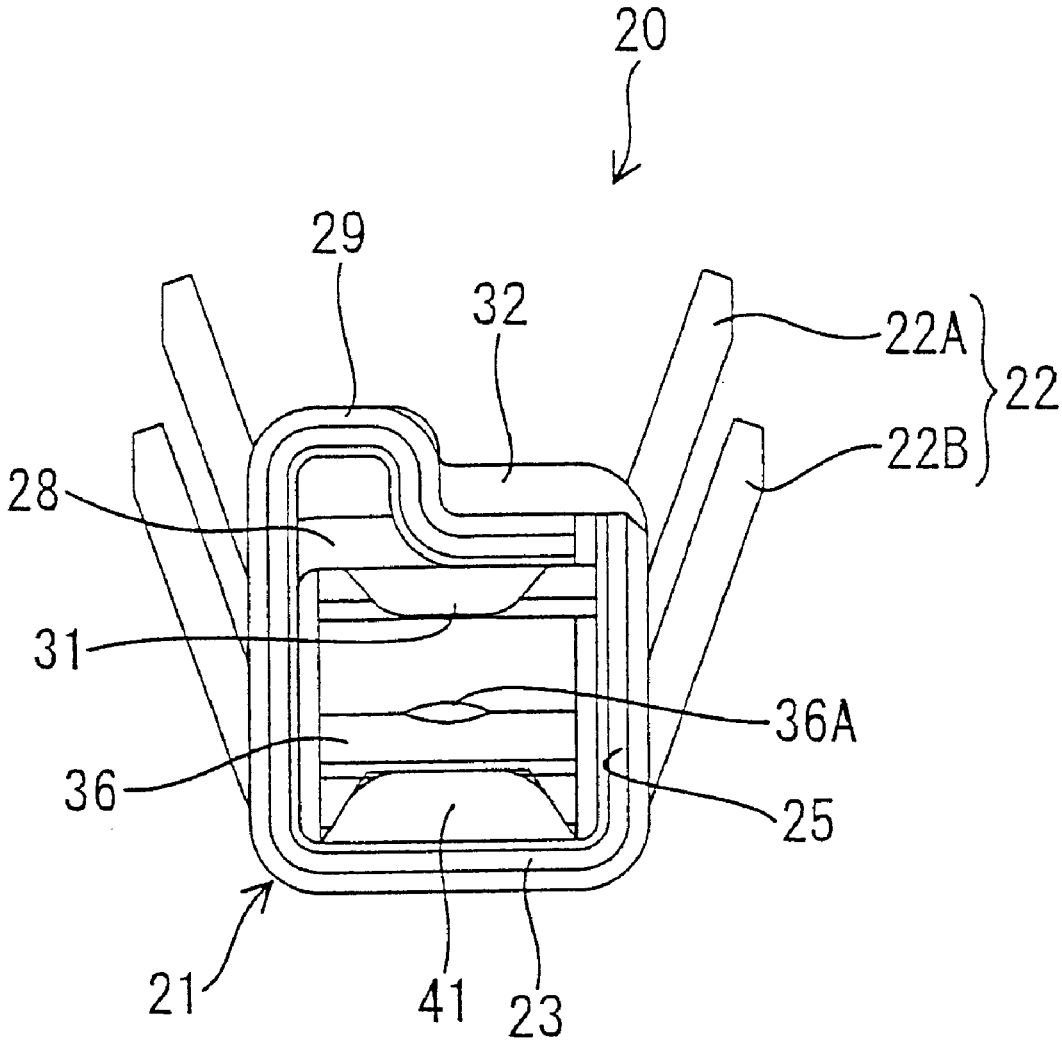
FIG. 4 is a front view of the female terminal according to the first embodiment of the present invention.

The barrel portion 22 is formed of a wire barrel 22*a* that crimps a core of the electric wire and of an insulation barrel 22*b*, positioned rearwardly to the wire barrel 22*a*, that crimps an insulation of the electric wire. The wire and insulation barrels 22*a*, 22*b* are folded at the widthwise ends of a bottom wall 23 which extends along the entire longitudinal length of the female terminal 20. The wire and insulation barrels 22*a*, 22*b* thus folded protrude upwardly to form a generally U-shape, respectively, as best seen in FIG. 4.

The angular tubular portion 21 is formed into a box shape by bending the blank P in a widthwise direction, and has a tab insertion opening 25 at the front end thereof for inserting the tab of the male terminal.

A ceiling wall of the angular tubular portion 21 is divided along a lengthwise direction into two parts to form a front ceiling wall 27 and a rear ceiling wall 28. On the front ceiling wall 27, as shown in FIG. 4, the left half is raised above the right half, forming a front stabilizer 29.

This front stabilizer 29 guides the female terminal 20 into a cavity of a connector housing (not shown) by sliding along a guide groove formed on the wall surface of the cavity of the connector, together with a rear stabilizer 33 to be described later.

As shown in FIG. 1, a contact protrusion 31 is formed at the front of the rear ceiling wall 28. The contact protrusion 31 protrudes or bulges downwardly, so that a tip portion thereof can make contact with the tab of the mating male terminal when the mating male terminal is inserted into the cavity of the connector housing.

Figure 5:
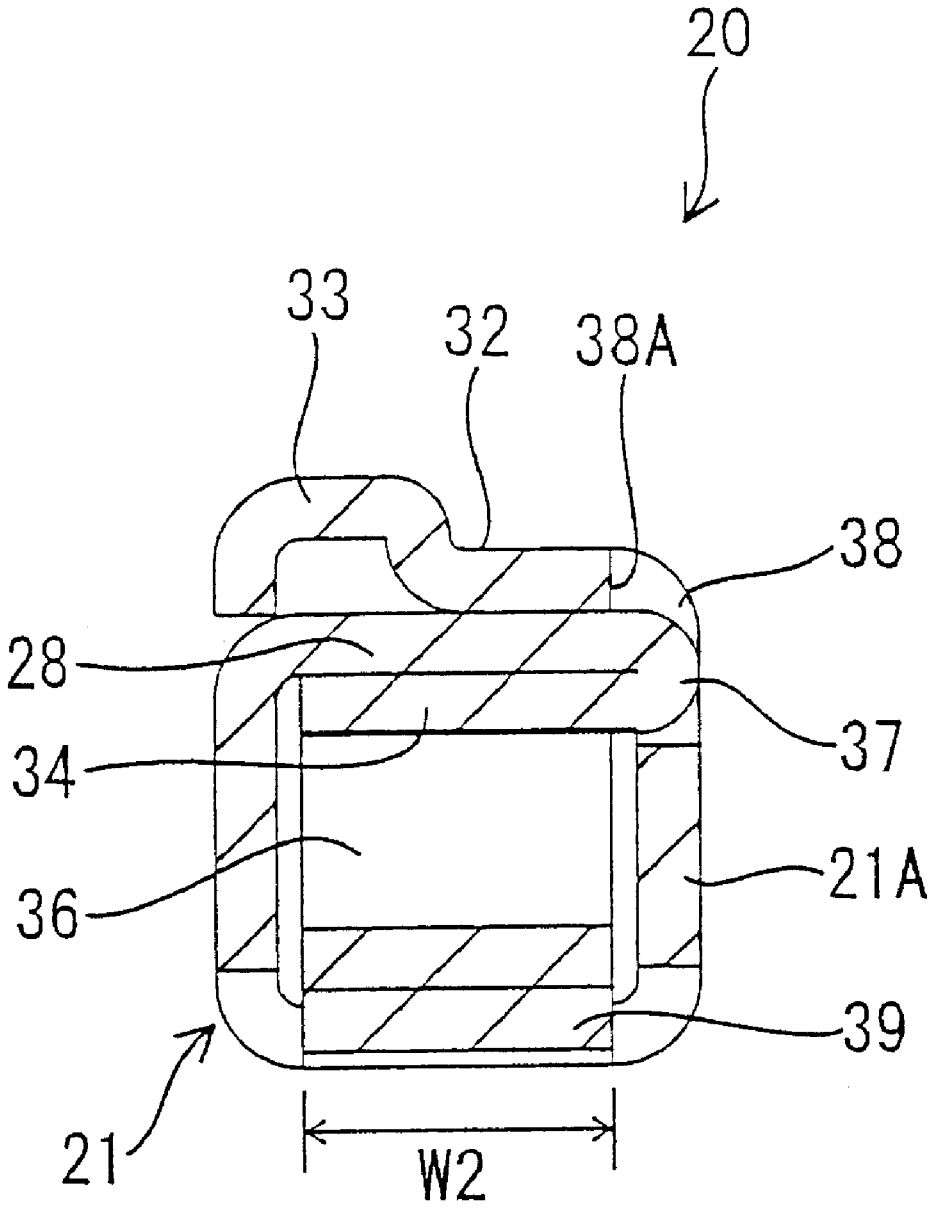
FIG. 5 is a front cross-sectional view of the female terminal according to the first embodiment of the present invention.

Moreover, an upper ceiling wall 32 is provided, folded onto the upper surface of the rear ceiling wall 28 and forming a double wall construction with the rear ceiling wall 28. As shown in FIG. 5, the left half of the upper ceiling wall 32 is raised above the right half, forming the aforementioned rear stabilizer 33.

As best seen in FIG. 1, the front and rear stabilizers 29, 33 are spaced apart from each other in the forward-rearward direction to define a space therebetween. A locking lance (not shown) formed in the cavity of the connector housing enters into this space, and retains the female terminal 20 within the cavity from withdrawal.

As shown in FIG. 6, in a pre-formed condition, a contract base portion 34 extends in a widthwise direction (upward direction in FIG. 6), and then a belt-shaped resilient contact 36 extends rearwardly from this contact base portion 34. In an assembled condition, the contact base portion 34 is folded under to lie beneath the lower surface of the rear ceiling wall 28 at a folded end portion 37, as illustrated in FIG. 5.

Additionally, formed on sidewall 21A of the angular tubular portion 21 is a receiving opening 38 which is positioned to correspond to, and thus accommodate the folded end portion 37. As best seen from FIG. 5, an edge portion 38A of the receiving opening 38 tightly engages the rear ceiling wall 28 in the proximity of the folder end portion 37, thereby preventing the rear ceiling wall 28 and the base portion 34 from being displaced away from each other in an upward-downward direction, and thus preventing the angular tubular portion 21 from being deformed open at the folded end portion 37.

The width W2 of the resilient contact 36 is set to be substantially the same as the inner width of the angular tubular portion 21. The resilient contact 36 is formed to have a generally U-shaped cross-section (as shown in FIG. 1), extending rearwardly slightly form the contact base portion 34, and folded downwardly toward a bottom wall 23 until it contacts the bottom wall 23, and then folded forwardly at the bottom wall 23.

After being folded forwardly, the resilient contact 3 extends toward the front of the female terminal 20, while sloping slightly upwardly so that it is resiliently deflectable in an upward and downward direction. The resilient contact 36 has a contacting point 36A formed by embossing an apex of the resilient contact 36 to bulge upwardly, so that the contacting point 36A oppositely faces the contact protrusion 31 provided on the rear ceiling wall 28. Consequently, the tab of the mating male terminal is elastically engaged between the contacting point 36A and the contact protrusion 31 for electrical connection.

As shown in FIG. 1, the angular tubular portion 21 is formed of an elastic support plate 39 that extends along the lower surface of the resilient contact 36 from the rear of the bottom wall 23 in an obliquely upward direction. The elastic support plate 39 supports the resilient contact 36 so that the support plate 39 cooperatively deflects with the resilient contact 36 in the upward-downward direction.

In addition, provided forwardly of the elastic support plate 39 is a guiding projection 41 cut and bent out of the bottom wall 23. The guiding projection 41 slopes upwardly from the front side of the bottom wall 23 towards the rear side of the bottom wall 23 so as to guide the tab of the male terminal between the front end of the resilient contact and the contact protrusion 31.

As described above, in accordance with the present embodiment, since the folded end portion 37 is accommodated in the receiving opening 38 formed on the side wall 21A of the angular tubular portion 21, the folded end portion 37 is no longer required to be disposed interiorly of the inner surface of the angular tubular portion 21. Accordingly, it is possible to increase the width W2 of the resilient contact 36 and thereby to increase the pressure of the resilient contact 36 with respect to the mating male terminal.

Further, the edge 38A of the receiving opening 38 tightly engages the rear ceiling wall 28 in the proximity of the folded end portion 37, thereby preventing the rear ceiling wall 28 and the contact base portion 34 from being displaced away form each other in an upward-downward direction. Accordingly, even if the tab of the mating male terminal strikes a wall surface of the angular tubular portion 21, it is possible to prevent the angular tubular portion 21 from being deformed open at the folded end portion 37.

The technical scope of the present invention is not limited to the foregoing embodiment. For example, the following modifications are also embraced by the technical scope of the present invention as defined in the claims.

Figure 12:
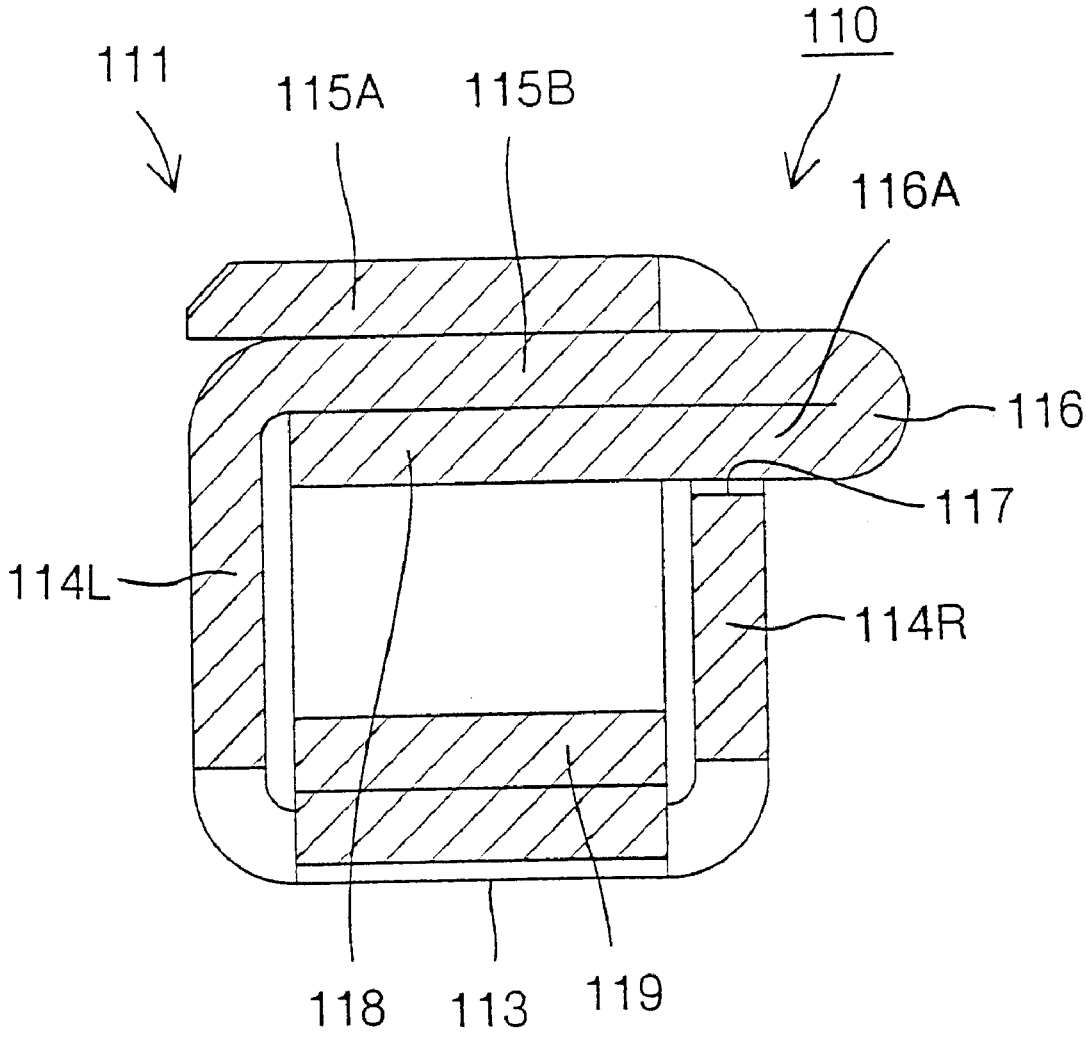
FIG. 12 is an enlarged front cross-sectional view illustrating a female terminal of a second embodiment of the present invention.
Figure 13:
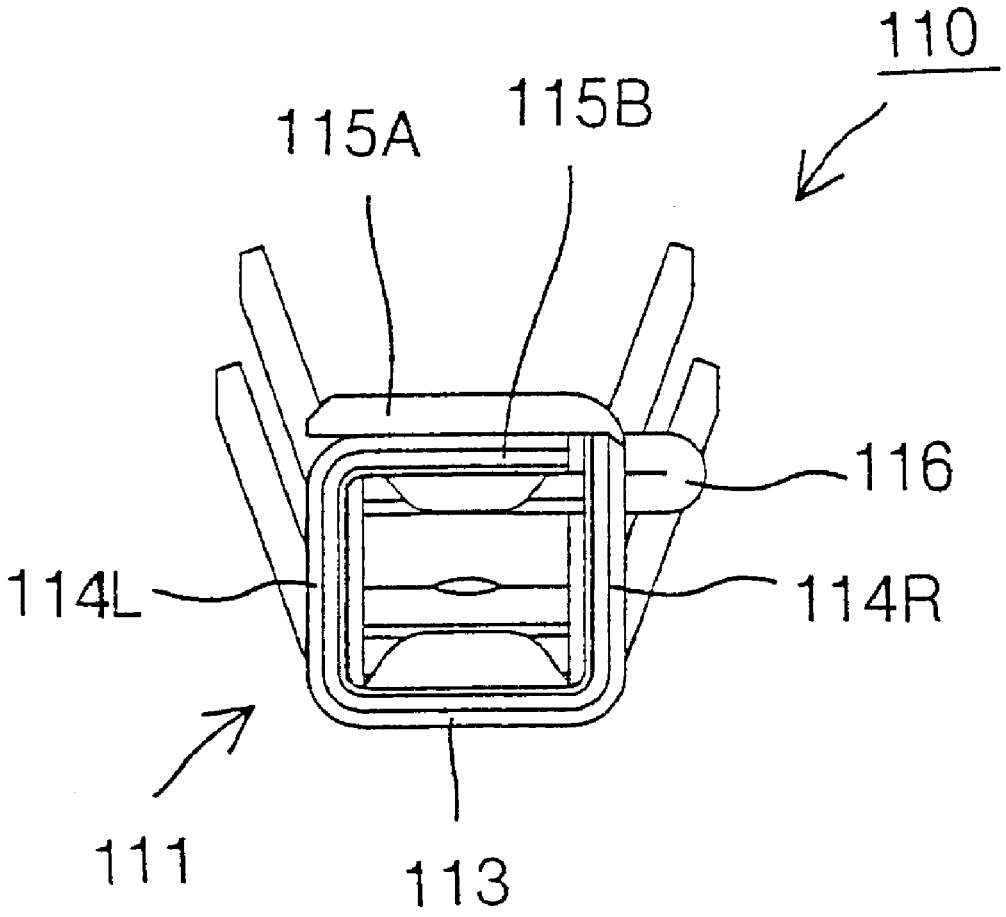
FIG. 13 is a front view illustrating the female terminal according to the second embodiment of the present invention.
Figure 14:
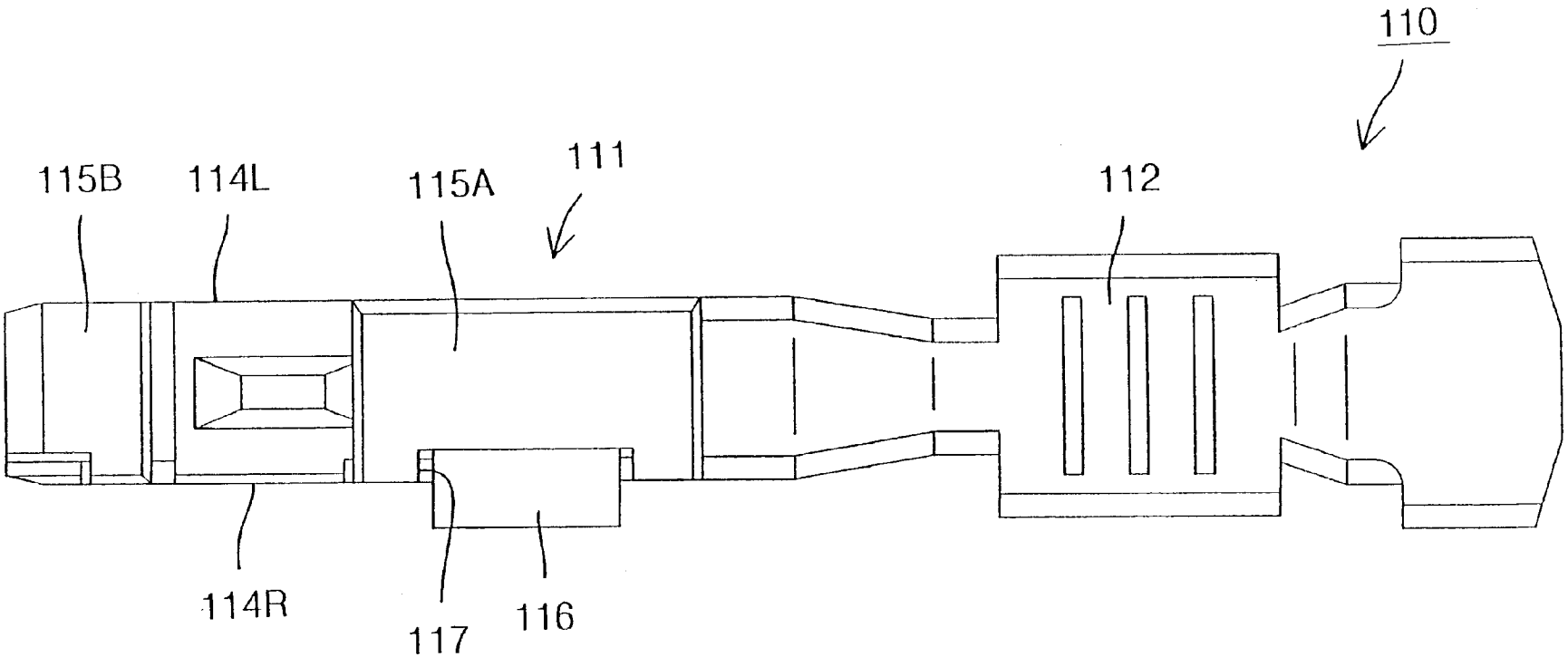
FIG. 14 is a plan view illustrating the female terminal according to the second embodiment of the present invention.
Figure 15:
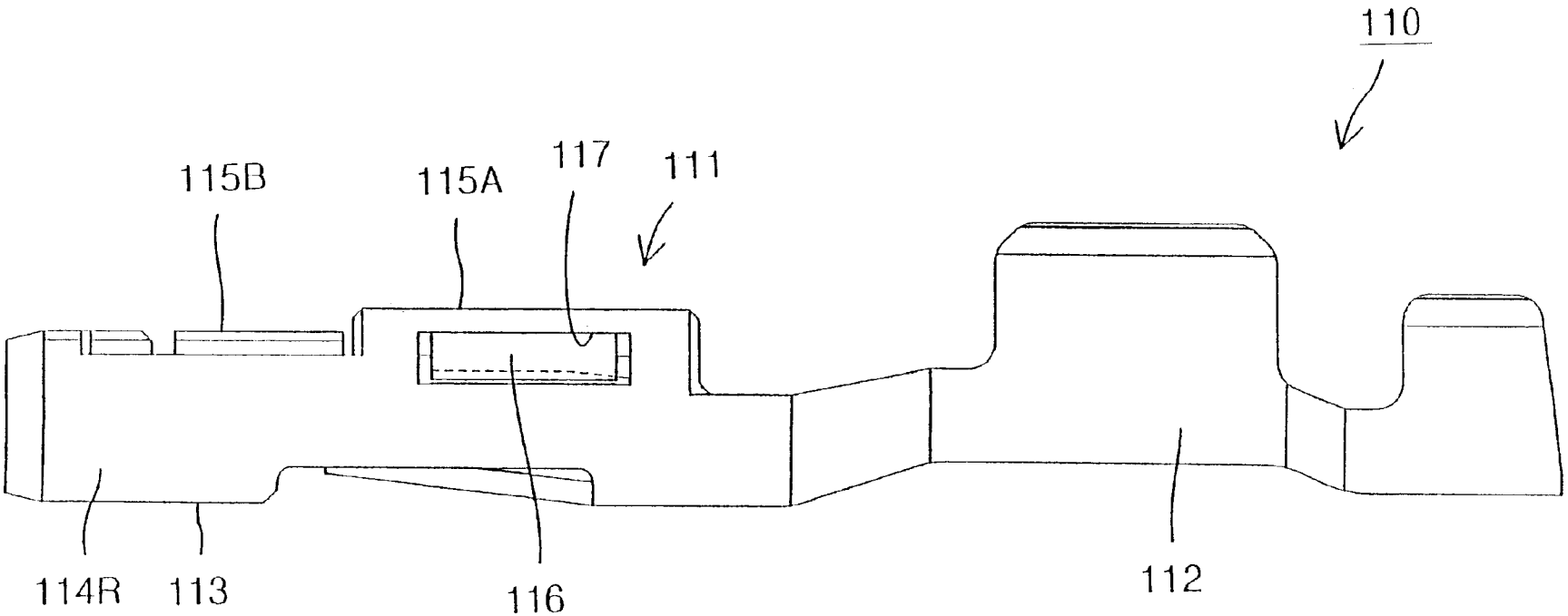
FIG. 15 is a side view illustrating the female terminal according to the second embodiment of the present invention.

(1) Although the folded end portion 37 is provided within the receiving opening 38 in the foregoing embodiment, the folder end portion 37 may project through and outwardly from the receiving 38, e.g., to form a guide member or a stabilizer that aids insertion of the female terminal into a connector housing in a proper orientation, as shown in FIG. 12.

(2) Although the resilient contact 36 extends toward the front of the female terminal 20 from the rear, the resilient contact 36 may be configured to extend reversely from the front of the female terminal 20 toward the rear.

(3) Although the contact base portion 34 is folded under the rear ceiling wall 28 to form a double thickness member, the contact base portion 34 may be formed into a single thickness member.

A second embodiment of the present invention will be described with reference to FIGS. 12–18.

Figure 18:
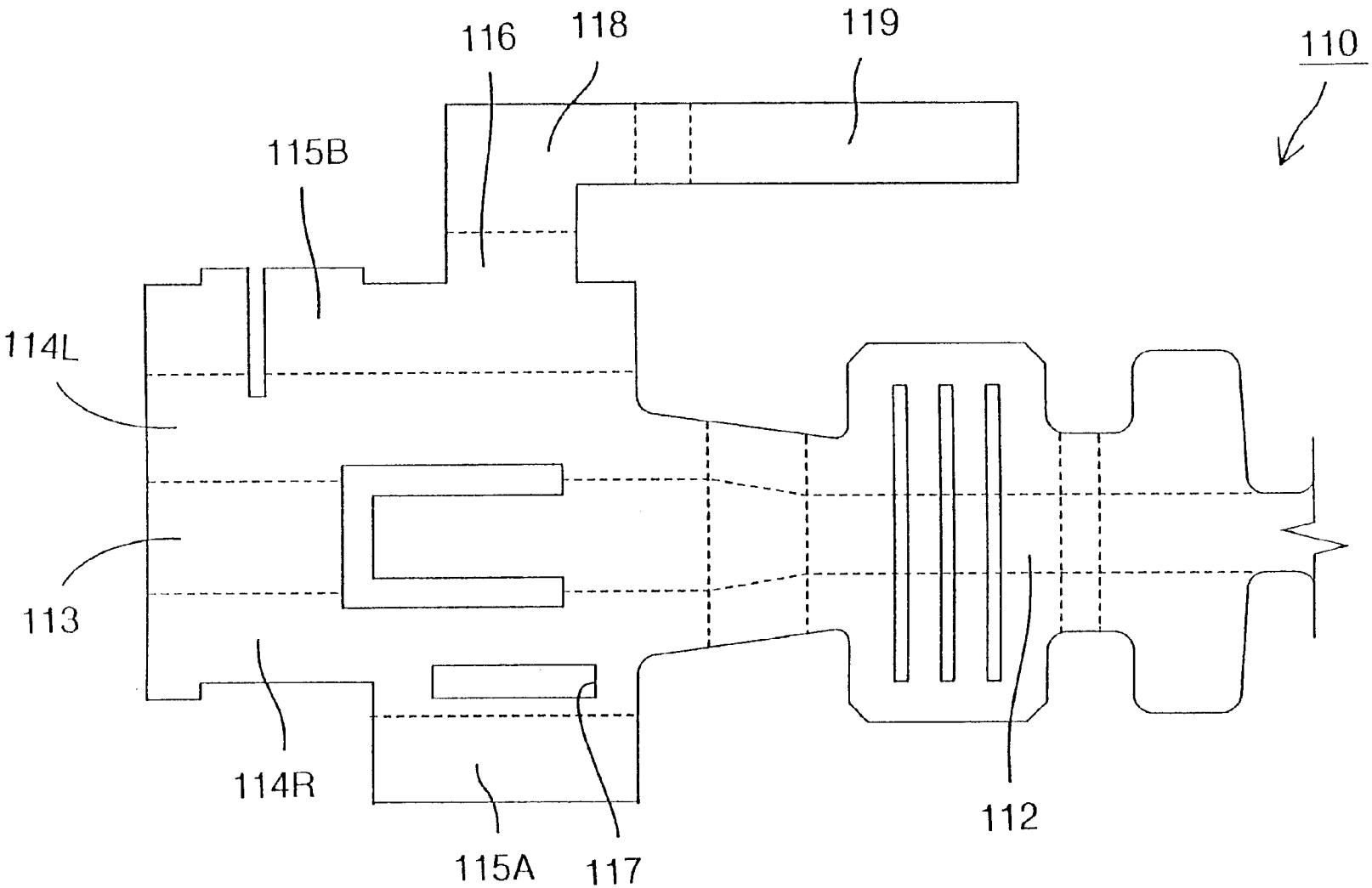
FIG. 18 is a plan view illustrating a blank of the female terminal according to the second embodiment of the present invention.

As shown in FIG. 18, a female terminal 110 is formed by punching and bending a metal plate into a desired configuration. The female terminal 110 forms a long and narrow shape in a forward-rearward direction, and has an angular tubular portion 111 at a front thereof, a stabilizer 116 that projects outwardly from an outer surface of the angular tubular portion 111, and a wire connection portion 112 at a rear end thereof.

The angular tubular portion 111 further has a bottom wall 113, a pair of left and right-side walls 114L, 114R upstanding from left and right-side edges of the bottom wall 113, and a pair of outer (upper) and inner (lower) top walls 115A, 115B that protrude inwardly from upper ends of the side walls 114L, 114R so that the outer and inner top walls 115A, 115B come into contact with each other in overlying relation.

As shown in FIGS. 12 and 18, the outer top wall or first wall 115A is formed continuously from a substantially rear half portion of the upper end of the right-side wall 114R only, and is folded inwardly to lie on an upper surface of the inner top wall 115B. The inner top wall 115B is formed continuously from an entire forward-rearward length of the upper end of the left-side wall 114L, and is folded inwardly to rest snugly beneath an inner surface of the outer top wall 115A.

As shown in FIGS. 12 and 18, the stabilizer 116 is formed from an extending portion that further extends outwardly from a right edge of the inner top wall 115B. The extending portion, positioned in the proximity of the rear end of the inner top wall 115B (FIG. 15), is folded back at an outermost end. A support wall 118 extends from the outermost end to the left along the inner surface of the inner top wall 115B, thereby forming a doubly thick wall stabilizer. A slot-shaped, long and narrow cut-away portion 117 is formed at the upper end of the right-side wall or second wall 114R. The stabilizer 116 passes through the cut-away portion 117, and projects outwardly from the outer surface of the right-side wall or second wall 114R. An opening height of the cut-away portion 117 is set to be slightly greater than a thickness of the stabilizer 116 (i.e., the dimensional difference is within a manufacturing tolerance), so that a root portion 116A of the stabilizer 116 does not move loosely in an upward-downward direction in the cut-away portion 117.

A resilient contact 119 projects downwardly from the rear edge of the support wall 118, and extends forwardly from a downward edge in a cantilevered manner. When a mating male terminal tab T is inserted between an upper surface of the resilient contact 119 and the support wall 118 to make electrical connection between the male and female terminals as show in FIG. 17, the resilient contact 119 deflects downwardly, and when the male terminal tab T is withdrawn, the resilient contact 119 moves upwardly to its original position. The resilient contact 119 comes into resilient contact with the male terminal tab T in a direction generally perpendicular to the stabilizer 116.

Since the stabilizer 116 is formed into a doubly thick wall structure, it can maintain a greater strength than that of a singly thick wall. Moreover, since the root portion 116A of the stabilizer 116 is fit within the cut-away portion 117 formed inside wall 114R of the angular tubular portion 111, it is possible to prevent the stabilizer 116 from deforming or bending in the upward-downward direction perpendicular to its protruding direction. Furthermore, since the stabilizer 116 protrudes laterally from the angular tubular portion 111, a height of the female terminal 110 can be reduced, compared to that with a stabilizer protruding upwardly from an angular tubular portion. Accordingly, a height of a connector housing, into which the female terminal 110 is inserted, can be reduced.

A third embodiment of the present invention will be described with reference to FIGS. 19–21.

As in the case of the second embodiment, a female terminal 220 is formed by punching and bending a metal plate into a desired configuration. The female terminal 220 forms a long and narrow shape in a forward-rearward direction, and has an angular tubular portion 221 at a front thereof, a stabilizer 228 that projects outwardly from an outer surface of the angular tubular portion 221, and a wire connection portion 222 at a rear end thereof.

The angular tubular portion 221 further has a bottom wall 223, a pair of left and right-side walls 224L, 224R upstanding from left and right-side edges of the bottom wall 223, and a pair of outer (upper) and inner (lower) top walls 225A, 225B that protrude inwardly from upper ends of the side wall 224L, 224R so that the outer and inner top walls 225A, 225B come into contact with each other in overlying relation.

Figure 19:
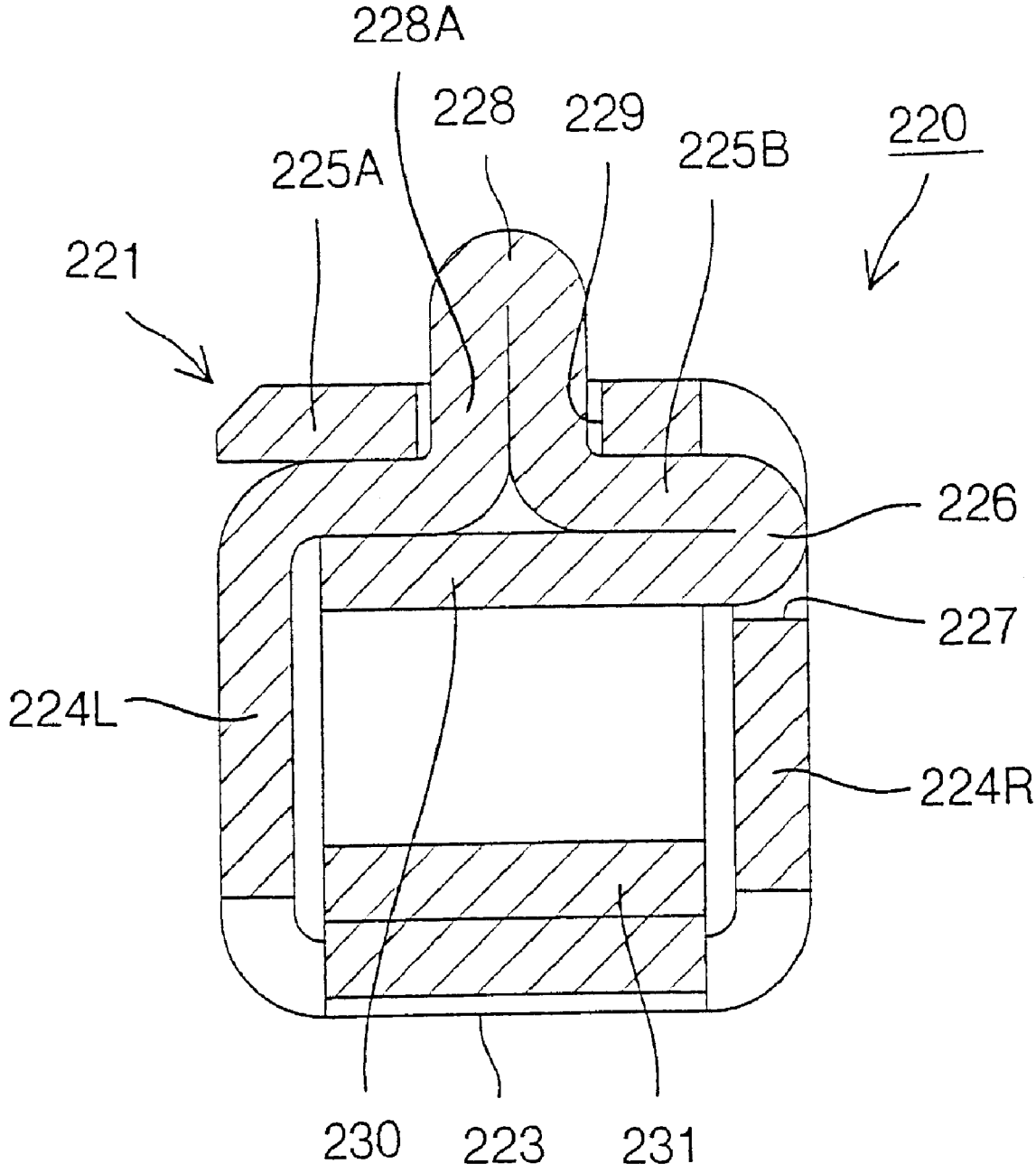
FIG. 19 is an enlarged front cross-sectional view illustrating a female terminal of a third embodiment of the present invention.

As shown in FIG. 19, the outer top wall 225A is formed contiguously from a substantially rear half portion of the upper end of the right-side wall 224R only, and is folded inwardly to lie on an upper surface of the inner top wall 225B. The inner top wall 225B is formed continuously from an entire forward-rearward length of the upper end of the left-side wall 224L, and is folded inwardly to rest snugly beneath an inner surface of the outer top wall 225A.

Figure 20:
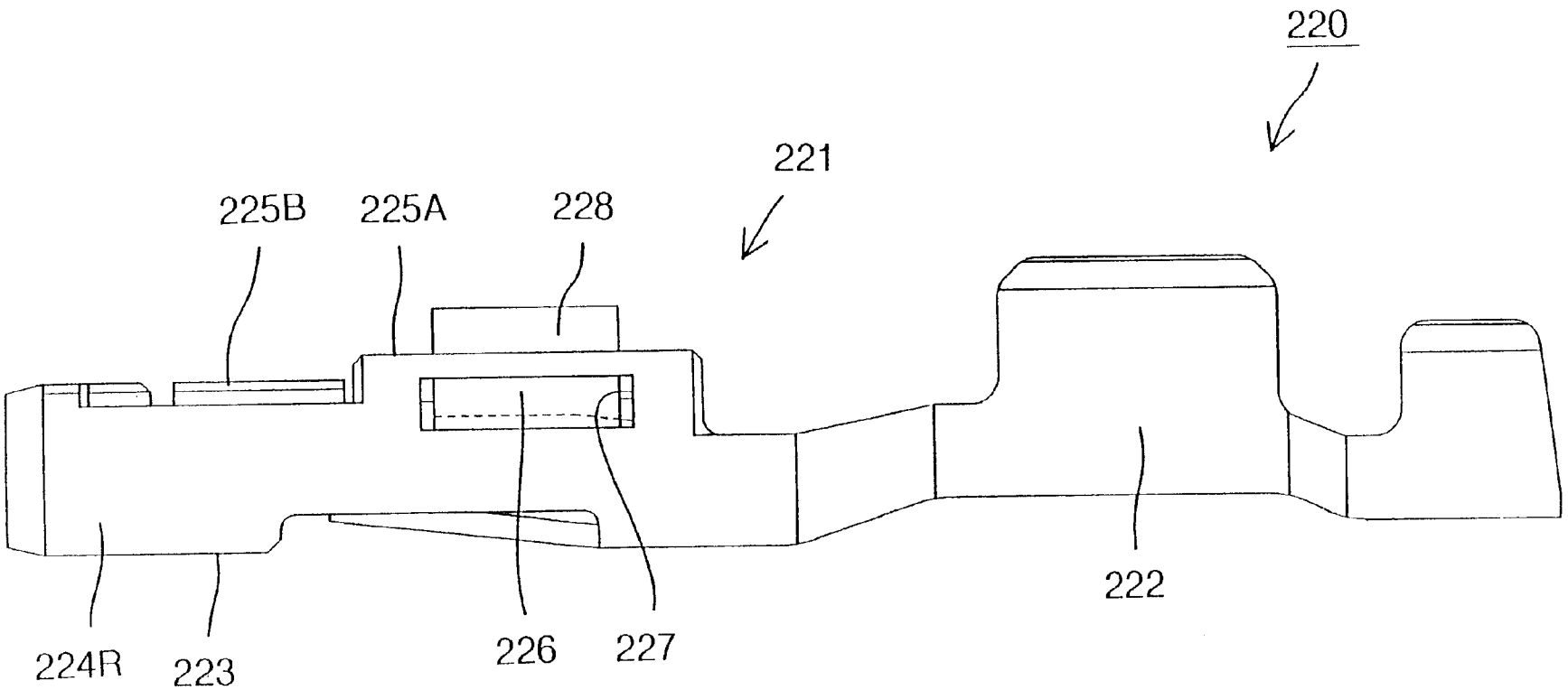
FIG. 20 is a side view illustrating a female terminal according to the third embodiment of the present invention.
Figure 21:
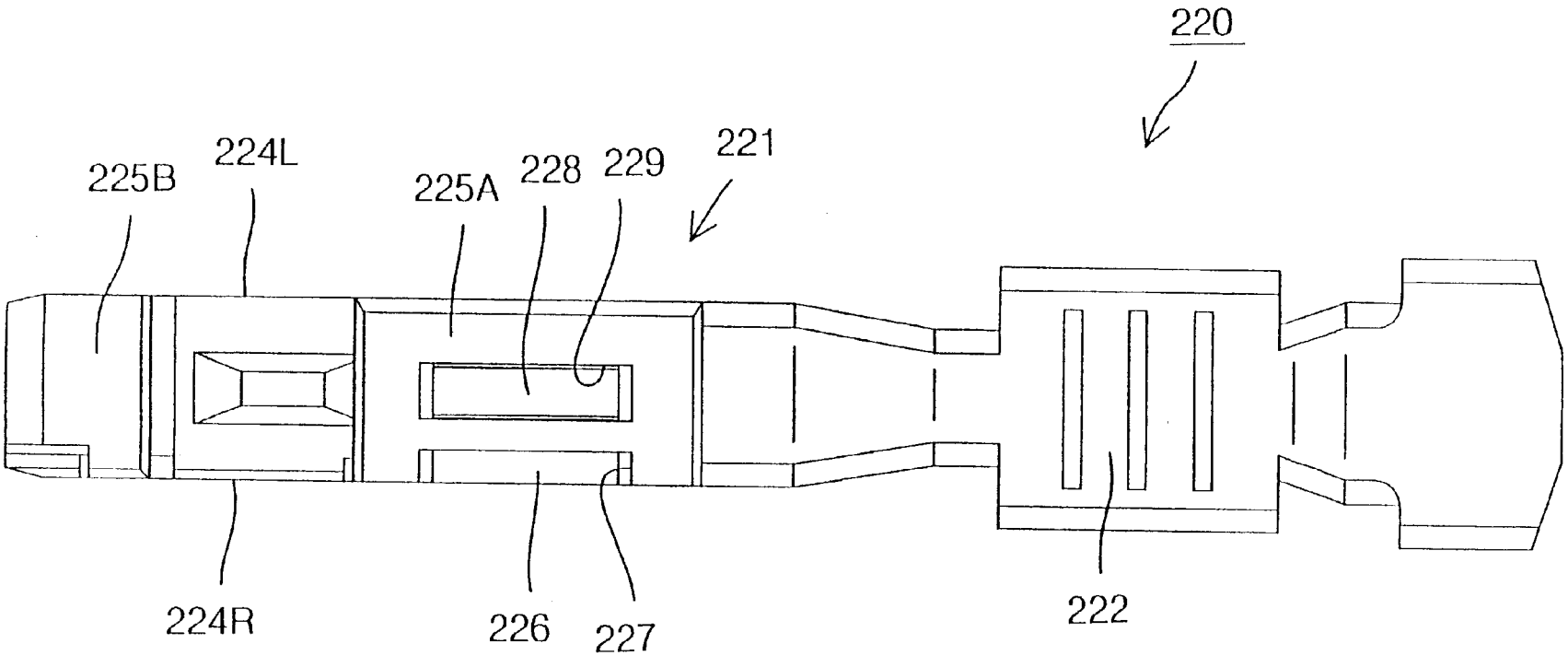
FIG. 21 is a plan view illustrating a female terminal according to the third embodiment of the present invention.

A support portion 226 is provided at a right edge of the inner top wall 225B as shown in FIG. 19, and is positioned in the proximity of the rear end of the inner top wall 225B as shown in FIG. 20. The support portion 226 is formed from an extending portion that further extends outwardly from the right edge of the inner top wall 225B, and is folded back at an outermost end. A support wall 230 extends from the outermost end to the left along the inner surface of the inner top wall 225B, thereby forming a doubly thick wall stabilizer. A slot-shaped, long and narrow support hole 277 is formed at the upper end of the right-side wall 224R. The support portion 226 is engaged within the support hole, so that the support portion 226 does not project outwardly from the outer surface of the right-side all 224R. An opening height of the support hole 227 is set to be slightly greater than a thickness of the support portion 226 (i.e., the dimensional difference is within manufacturing tolerance), so that the support portion 226 does not move loosely in an upward-downward direction in the support hole 227.

The stabilizer 228 is in the form of a doubly thick wall, formed by buckling upward left-side and right-side plate portions so that stabilizer 228 projects upwardly at a central portion of the transverse direction of the inner top wall 225B. A slot-shaped, long and narrow cut-away portion 229 is formed in the outer top wall 225A, so that the stabilizer 228 passes through the cut-away portion 229, and projects outwardly from the outer surface of the outer top wall 225A. An opening width of the cut-away portion 29 is set to be slightly greater than a thickness of the stabilizer 228 (i.e., the dimensional difference is within a manufacturing tolerance), so that a root portion 228A of the stabilizer 228 does not move loosely in a left-right direction in the cut-away portion 229.

Figure 16:
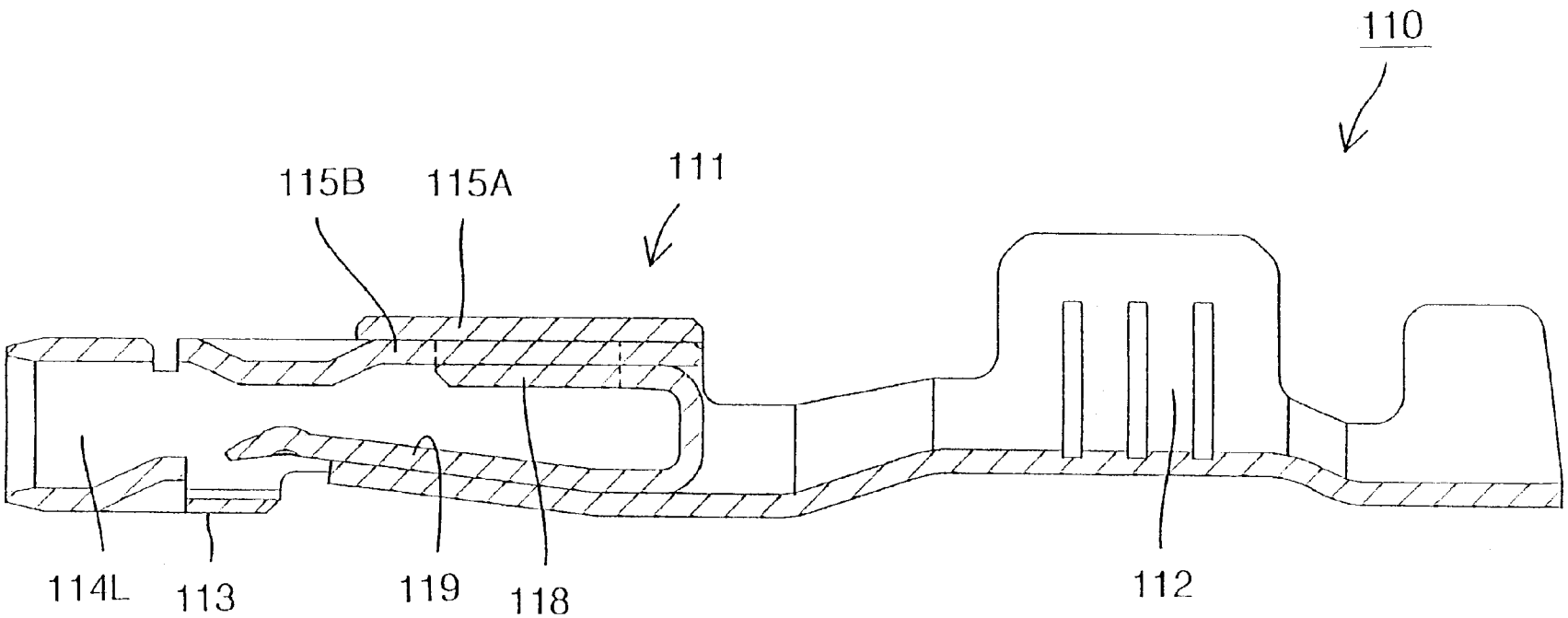
FIG. 16 is a side cross-sectional view illustrating the female terminal according to the second embodiment of the present invention.
Figure 17:
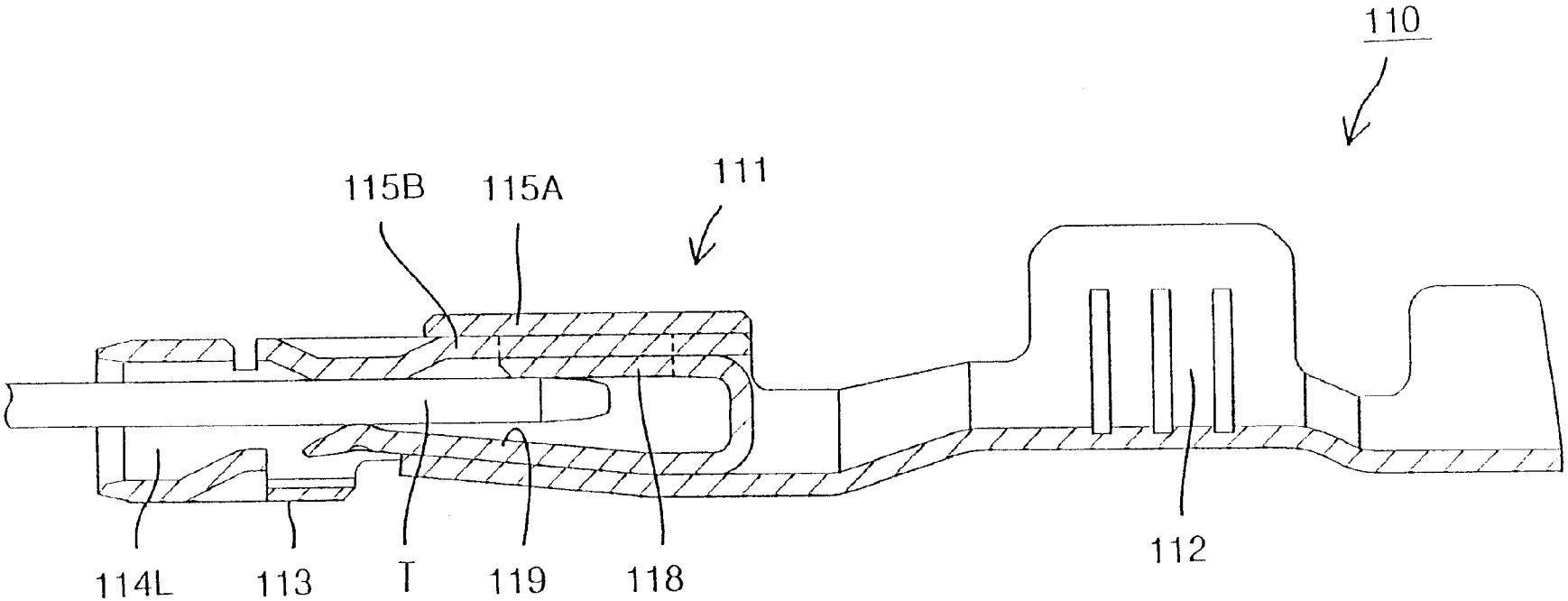
FIG. 17 is a side cross-sectional view illustrating the condition in which a mating male terminal is inserted in the female terminal according to the second embodiment of the present invention.

A resilient contact 231 project downwardly from a rear edge of the support wall 230, and extends forwardly from a downward edge in a cantilevered manner (as in FIG. 16 with respect to the previous embodiment). When a mating male terminal tab (not shown) is inserted between an upper surface of the resilient contact 231 and the support wall 230 to make electrical connection between the male and female terminals the resilient contact 231 deflects downwardly, and when the male terminal tab is withdrawn, the resilient contact 231 moves upwardly to its original position. The resilient contact 231 comes into resilient contact with the male terminal tab in a direction parallel to the stabilizer 228.

Since the stabilizer 228 is formed into a doubly thick wall structure, it can maintain a greater strength than that of a singly thick wall. Moreover, since the root portion 288A of the stabilizer 228 is fitted within the cut-away portion 229 formed in the outer top wall 225A of the angular tubular portion 221, it is possible to prevent the stabilizer 228 from deforming or bending in the transverse direction perpendicular to its protruding direction.

Furthermore, the support portion 226 is provided at the right side edge of the inner top wall 225B that constitutes a forming body of the stabilizer 228. The support portion 226 supports the stabilizer 228 by fitting within the support hole 227 formed at the upper end of the right-side wall 224R. Therefore, even if an external force acts downwardly on the stabilizer 228, the inner top wall 225B and the stabilizer 228 do not displace or deform downwardly because of the fit of the support portion 226 with the support hole 227.

The technical scope of the present invention is not limited to the foregoing embodiments. For example, the following modifications are also embraced by the technical scope of he present invention as defined in the claims.

(1) The present invention is not limited to female terminal fittings; obviously, it is equally applicable to male terminal fittings.

(2) In the above second and third embodiments, the support wall that supports the resilient contact is folded under the inner top wall that constitutes the forming body of the stabilizer. However, the support all need not be provided, depending on the location of the resilient contact, e.g., if the resilient contact extends from a bottom wall.

(3) In the above third embodiment, the stabilizer is provided at a central portion in the transverse direction. However, the stabilizer can be provided at either a left end portion or a right end portion.

(4) In the above second and third embodiments, the resilient contact deflects in the upward-downward direction. However, the present invention is equally applicable to the resilient contact configured for left-right lateral deflection.

It is noted that the foregoing example have been provided merely for the purpose of explanation and are in no way to be construed as limiting of the present invention. While the present invention has been describe with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects.

Although the present invention has been described herein with reference to particular means, materials and embodiments the present invention is not intended to be limited to the particulars disclosed herein. Rather, the present invention extends to all functionally equivalent structures, methods and uses, such as are within the scope of the appended claims.

The present disclosure relates to subject matter contained in priority Japanese Applications No. Tokugan 2000-383770, filed on Dec. 18, 2000 and No. 2001-274662, filed on Sep. 11, 2001, which are herein expressly incorporated by reference in its entirety.

What is claimed is:

1. A female terminal comprising:

an angular tubular portion extending in a lengthwise direction and having an insertion opening at one end thereof for inserting a mating male terminal, the angular tubular portion further having adjacently disposed first and second walls extending in the lengthwise direction;

a base portion provided at the first wall of the angular tubular portion, the base portion including an end portion extending toward the second wall in a widthwise direction; a resilient contact extending from the base portion in the lengthwise direction and folded inwardly so that the resilient contact extends within the angular tubular portion for elastically making contact with a tab of the mating male terminal; and a receiving portion positioned to correspond to and receive the end portion of the base portion, so that a width of the resilient contact can be increased, whereby a contact pressure of the resilient contact with respect to the tab of the mating male terminal can be increased without increasing the size of the angular tubular portion;

wherein the end portion of the base portion extends through the receiving portion, and projects beyond an outer surface of the second wall to form a guide member that aids insertion of the female terminal into a connecting device in a proper orientation.

2. The female terminal according to claim 1, wherein the resilient contact has a width substantially the same as an inner width of the angular tubular portion.

3. The female terminal according to claim 1, wherein the receiving portion is formed in at least one of the first and second walls and positioned to correspond to and receive the end portion of the base portion.

4. The female terminal according to claim 1, wherein the end portion of the base portion is fixedly secured within the receiving portion.

5. The female terminal according to claim 3, wherein the receiving portion comprises a cut-away portion formed between the first and second walls, and the cut-away portion has a window that allows the end portion of the base portion to be observed from an exterior side of the first wall.

6. The female terminal according to claim 1, wherein the base portion comprises a double wall structure, and the end portion of the base portion comprises a folded end portion.

7. The female terminal according to claim 6, wherein the receiving portion comprises a cut-away portion, and an edge of the cut-away portion tightly engages the base portion at or in the vicinity of the folded end portion, thereby preventing the folded end portion from being deformed open.

8. The female terminal according to claim 6, wherein the folded end portion extends through the receiving portion, and rigidly projects from an outer surface of the second wall to form a guide member that aids insertion of the female terminal into a connecting device in a proper orientation.

9. A female terminal comprising:

an angular tubular portion extending in a lengthwise direction and having an insertion opening at one end thereof for inserting a mating male terminal, the angular tubular portion further having adjacently disposed first and second walls extending in the lengthwise direction;

a base portion provided at the first wall, the base portion comprising a double wall structure having a folded end portion, the folded end portion extending toward the second wall in a widthwise direction;

a resilient contact extending from the base portion in the lengthwise direction and folded inwardly so that the resilient contact extends within the angular tubular portion for elastically contacting a tab of the mating male terminal; and a receiving opening formed in at least one of the first and second walls and positioned to correspond to and receive the folded end portion of the base portion;

wherein the folded end portion extends through the receiving opening, and rigidly projects from an outer surface of the second wall to form a guide member that aids insertion of the female terminal into a connecting device in a proper orientation.

10. The female terminal according to claim 9, wherein an edge of the receiving opening tightly engages the base portion at or in proximity to the folded end portion, thereby preventing the folded end portion from being deformed open.

11. The female terminal according to claim 9, wherein the receiving opening is formed between the first and second walls, and has a window that allows the folded end portion of the base portion to be observed from an exterior side of the first wall.

12. A female terminal comprising:

an angular tubular portion extending along a longitudinal direction and having a bottom wall, opposed side walls protruding upwardly from side edges of the bottom wall, and a top wall having upper and lower wall portions, the upper and lower wall portions protruding inwardly from the opposed side walls so that the upper wall portion is positioned in overlying relation with respect to the lower wall portion;

a cut-away portion formed in at least one of the top wall and the side walls; and a double wall stabilizer configured to aid insertion of the female terminal into a cavity of a connector housing in a proper orientation, and the double wall stabilizer comprising a double wall structure formed from the lower wall portion of the top wall, wherein the double wall stabilizer extends out of an outer surface of the angular tubular portion through the cut-away portion, and is tightly secured at a root portion thereof in the cut-away portion.

13. The female terminal according to claim 12, wherein the cut-away portion is formed at an upper end portion of one side wall, and wherein the double wall stabilizer comprises a folded end portion of the lower wall portion of the top wall forming the double wall stabilizer that protrudes through the cut-away portion in a direction parallel to a plane of the upper wall portion of the top wall and in a direction perpendicular to the longitudinal direction.

14. The female terminal according to claim 12, wherein the cut-away portion is formed in the upper wall portion of the top wall, wherein the double wall stabilizer comprises an upwardly protruding portion of the lower wall portion forming the double wall stabilizer that extends through the cut-away portion in a direction perpendicular to a plane of the upper wall portion of the top wall, wherein the double wall stabilizer is tightly secured at the root portion within the cut-away portion, and wherein an end portion of the lower wall portion extends toward the side wall and is secured within a support opening formed in one of the side walls.

15. The female terminal according to claim 14, further comprising a resilient contact that extends from the lower wall portion in the longitudinal direction for elastically making contact with a mating male terminal, wherein the end portion of the lower wall portion is tightly secured within the support opening, so that the lower wall portion supports the double wall stabilizer.

16. The female terminal according to claim 14, wherein the double wall stabilizer is formed by buckling upward left-side and right-side plate portions of the lower wall portion so that the double wall stabilizer projects upwardly at a central portion of the left-right direction of the lower wall portion of the top wall.

* * * * *